US005147269A

United States Patent [19]

Jondelius

[11] Patent Number: 5,147,269

[45] Date of Patent: Sep. 15, 1992

[54] METHOD FOR MANUFACTURING CARTONS AND BLANKS THEREFOR AND APPARATUS FOR CARRYING OUT THE METHOD

[76] Inventor: Björn Jondelius, Upplandsgatan 84, S-113 44 Stockholm, Sweden

[21] Appl. No.: 572,225

[22] Filed: Aug. 24, 1990

[51] Int. Cl.[5] ..... B31B 3/14; B31B 3/22; B31B 3/28

[52] U.S. Cl. ..... 493/57; 493/82; 493/175; 493/468; 30/2

[58] Field of Search ..... 493/51, 57, 82, 83, 493/175, 295, 468; 30/2

[56] References Cited

U.S. PATENT DOCUMENTS

| | | | |
|---|---|---|---|
| 1,528,073 | 3/1925 | Phillips | 493/175 |
| 1,882,049 | 10/1932 | Wellman | 493/175 |
| 2,759,544 | 8/1956 | De Vries | 30/2 |
| 2,826,969 | 3/1958 | Wasyluka et al. | 493/468 |
| 2,915,932 | 12/1959 | Gross | 30/2 |
| 3,015,197 | 1/1962 | Eichorn | 53/208 |
| 4,308,020 | 12/1981 | Langen | 493/468 |
| 4,441,948 | 4/1984 | Gillard et al. | 493/295 |
| 4,659,322 | 4/1987 | Boudin et al. | 493/57 |
| 4,932,930 | 6/1990 | Coalier et al. | 493/295 |

*Primary Examiner*—William E. Terrell

*Attorney, Agent, or Firm*—Nies, Kurz, Bergert & Tamburro

[57] ABSTRACT

A method and apparatus for producing blanks to form into cartons, boxes or the like from a continuous sheet, the carton having a substantially tubular shaped part which, in cross-section, has three or more sides, the blank including continuous, sequentially disposed portions which will provide carton side parts and flap parts at one or both of the ends of the tubular carton side part at some or each of the side parts, the ends of the tubular carton part being closed by the flap parts. A sheet or blank of required shape is produced using a fixture with a longitudinal extension that corresponds to the longitudinal extension of the tubular carton part and has a cross-sectional outer profile which corresponds to the cross-sectional profile of the tubular carton part. An edge part of a material sheet of at least the required size for a blank is attached to the fixture preferably along a longitudinally extending corner part of the fixture, the corner part forming a demarcation line between two adjacent side parts of the carton blank and at which line the sheet is folded, and the side parts wrapped around the fixture in the tubular carton part configuration with flap parts which are a continuation of the carton side parts. The fixture can be used as a template when it is necessary to cut and remove excess parts of the sheet attached to and formed around the fixture.

19 Claims, 2 Drawing Sheets

METHOD FOR MANUFACTURING CARTONS AND BLANKS THEREFOR AND APPARATUS FOR CARRYING OUT THE METHOD

The present invention relates to a method for manufacturing sheet blanks, from which cartons, boxes and like containers can be made from a continuous sheet of material, the final carton shape including a substantially tubular, carton-part constructed from blank, with a continuous row of sequentially disposed carton side members, and further including flap parts at preferably each of the two ends of the carton-part, the flap parts being connected with a respective side-part and functioning to close the tubular carton-part.

The invention also relates to apparatus for carrying out the method.

Cartons of the aforesaid kind are typically produced by high-capacity mechanical punching and creasing processes. This requires large investments in machines, tools, etc. these high investments being unacceptable in the case of low capacity requirements.

The present invention relates to a method and apparatus for the low-capacity production of such cartons in an efficient manner and at low costs. The invention can be applied with both manual and semi-manual production of carton blanks of a given size with a starting point from carton blanks of larger sizes.

The invention thus relates to a method for manufacturing sheet blanks for cartons, boxes and the like from a continuous sheet, the cartons including a substantially tubular, not-necessarily cylindrical carton-part which exhibits in cross-section at least three side walls and which is constructed from a sheet blank having a continuous row of sequentially arranged carton pieces which side walls, and further comprising flap parts at the sheet blank further including flap parts at least at one of the two ends of the carton part and on at least certain of the side parts, the flap parts functioning to enable closing of the tubular carton part.

The method is particularly characterized in that a sheet blank of requisite shape is produced with the aid of a fixture or jig having a longitudinal extension which corresponds to the longitudinal extension of the tubular carton part and having a cross-sectional outer profile which corresponds to the cross-sectional outer profile of the tubular carton part; in that a sheet of requisite size is mounted on the fixture with one edge part of said sheet preferably contiguous with a longitudinally extending corner part of the fixture, the corner part forming a demarcation line between two mutually adjacent side parts; the sheet being folded, wrapped, around the fixture to form the part which will become the tubular carton part and also the flap parts which are a continuation of the carton part; and when applicable excess portions of the sheet mounted on the fixture are removed, preferably while using the fixture as a template.

The invention also relates to apparatus for manufacturing cartons, sheet blanks for making boxes and the like from a continuous sheet of material, said carton having a substantially tubular, carton part which in cross-section will have at least three sides and which is constructed with the aid of a blank which will have a continuous row of sequentially arranged carton side parts, and further having flap parts on at least one of the two ends of said carton side parts on at least some of the parts, so at least one end of the said tubular carton part can be closed by means of the flap parts.

The apparatus is particularly named in that it consists of a fixture or jig which has a longitudinal extension that corresponds to the longitudinal extension of the desired tubular carton part and a cross-sectional outer profile which corresponds substantially to the cross-sectional outer profile of the desired tubular carton part, and in that attachment devices are provided so that an edge part of a sheet is secured contiguous with a longitudinally extending corner part of the fixture, the corner part forming a demarcation line between two mutually adjacent the parts, said sheet being folded, wrapped, around the fixture so as to form the tubular carton part and the flap parts which are on extension of side parts of the carton part; and the fixture can provide a template for facilitaing removal of excess parts of a sheet mounted on the fixture.

The invention will now be described in more detail with reference to exemplifying embodiments thereof illustrated in the accompanying drawings; in which FIG. 1 illustrates schematically a first embodiment of an inventive fixture, seen transversely to the longitudinal axis of the fixture;

Figure 3:
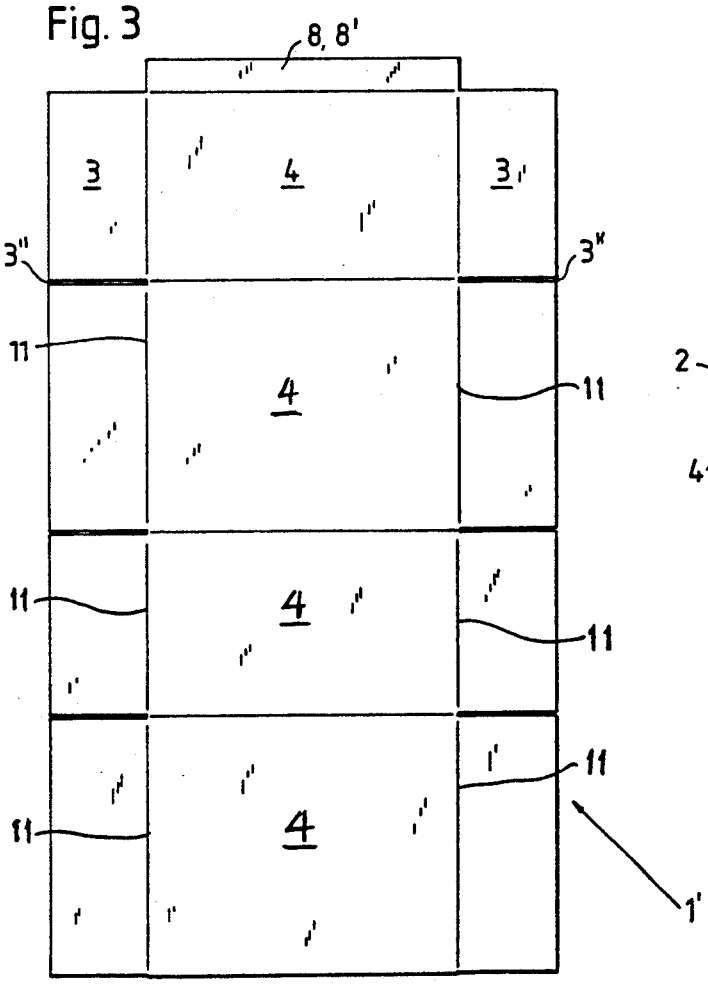
FIG. 3 illustrates a carton sheet blank produced with the aid of and in accordance with a fixture substantially of the kind illustrated in FIGS. 1 and 2.
Figure 4:
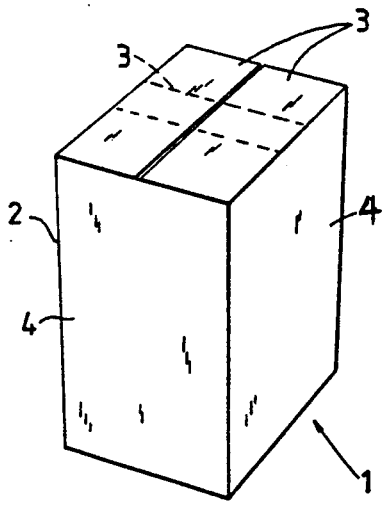
FIG. 4 is a perspective view of a carton or box produced from a sheet blank substantially according to FIG. 3.

In FIG. 4, the reference numeral 1 identifies a carton produced in accordance with the invention, while in FIG. 3 the reference numeral 1' identifies a continuous, finished sheet blank produced from a sheet having a size which includes at least said finished sheet blank.

The carton 1 comprises a substantially tubular, carton par 2, which could be cylindrical but in the illustrated embodiment has a substantially rectangular outer cross-sectional profile, flap parts 3 located preferably at each of the two ends of the carton part, these flap parts functioning to close the end of the completed tubular carton.

In cross-section, the illustrated carton blank 1' is constructed from a continuous row of sequentially disposed carton members which form side parts 4, FIG. 3.

Figure 1:
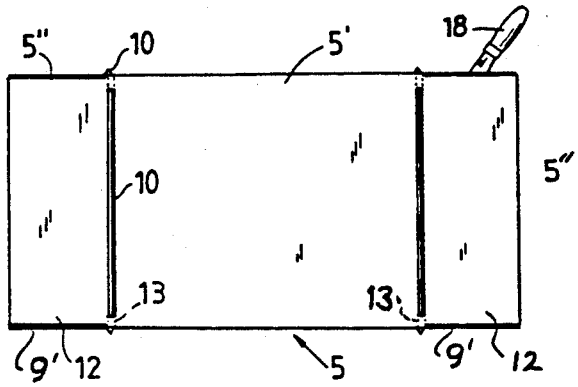
Figure 2:
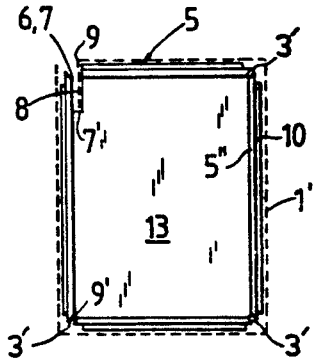
FIG. 2 illustrates the fixture of FIG. 1, seen from the right of said Figure.

In FIGS. 1 and 2, the reference numeral 5 identifies a fixture which has a longitudinal extension that corresponds to the longitudinal extension of the tubular carton part, and a cross-sectional outer profile which corresponds substantially to the cross-sectional outer profile of the tubular carton pat 2. The illustrated fixture 5 includes attachment devices 6 in the form of elongated retaining slots 7 which are intended to receive an edge part 8 of a sheet blank, preferably contiguous with an elongated corner part 9 thereof, said corner part 9 forming a demarcation part between two mutually adjacent side parts 4; a sheet blank is intended to be folded, wrapped, around the fixture, FIG. 2, to form the tubular carton part 2 and also flap parts as a continuation of the carton part. The fixture is also intended to form a template to facilitate removal; excessive parts of a sheet blank mounted on the fixture, when necessary.

An edge part 8 of a sheet to be made into a sheet blank is intended to be inserted into said retaining slot 7 and retained, and the sheet then folded to form said edge part 8 into a securing flap 8' by means of which, when constructed, the tubular carton part is held together in a known manner.

According to one preferred embodiment, illustrated in FIGS. 1 and 2 the slot 7 has a predetermined depth to which the edge part 8 can be inserted, the depth of said slot 7 functioning to determine the length of the securing flap 8 transversely to the longitudinal direction, i.e. in the circumference direction of the tubular carton part.

Projecting substantially in the aforesaid longitudinal direction, from the part 5' of the fixture, said part corresponding to the tubular carton part 2, are support parts 5'' between which are formed cutting slits 9' enabling the fixture to be used as a template or the like when forming said flap parts 3 with the aid of cuts 3' made substantially in the longitudinal direction of the fixture.

According to the one preferred embodiment of FIGS. 1 and 2, the fixture includes externally mounted strips 10 which form ridges that extend substantially transversely to said longitudinal direction at the ends of the central fixture part 5', such strips 10 functioning to produce bending lines 11, FIG. 3, in the sheet at the junction between the tubular carton side parts 4 and the flap parts 3, primarily by the ridge strips being pressed into the sheet as it is wrapped around the fixture.

In the case of the embodiment of the fixture illustrated in FIGS. 1 and 2, the fixture comprises a substantially tubular, body having a central part 5' which functions to form the tubular carton part 2, and two end parts 12 which adjoin the central part 5'. The end parts 12 form support parts which function to form flap parts from the sheet and which include requisite cutting slots 9' or slits 9', in the illustrated case, corner-located slits, which is typical with such apparatus. The body of the fixture includes two, internally located end walls 13, where one end wall is located at each junction between the central part 5' and respective end parts 12. The end walls have a stiffening and retaining effect. As with the illustrated case, the retaining slot 7 can be given a predetermined depth, by providing a recess 7' in each end wall, as seen from FIG. 2.

Figure 5:
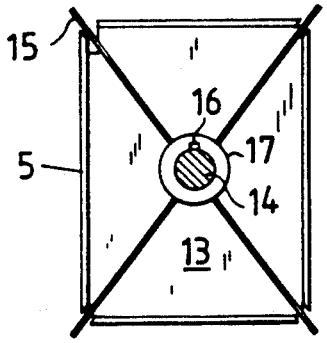
FIG. 5 illustrates schematically a mechanical knife arrangement for producing flap parts of a sheet, and illustrates the fixture as seen in FIG. 2.
Figure 6:
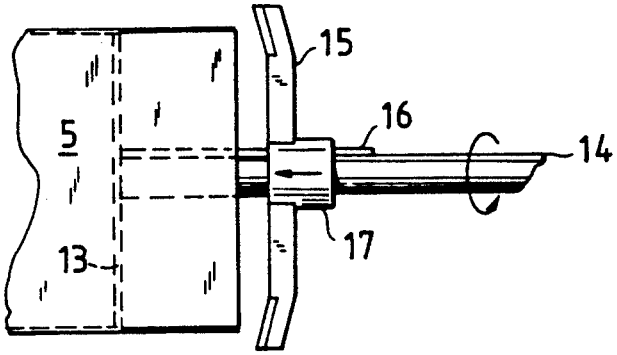
FIG. 6 illustrates schematically the arrangement shown in FIG. 5, seen from the left in said Figure.

According to a second embodiment of the fixture, the fixture can be rotated about a longitudinal axle or shaft. As illustrated in FIGS. 5 and 6 in the case of this embodiment, an axle or shaft 14 extends at least from one end wall 13 or the like and is connected to means (not shown) for rotation of the fixture. According to a further portion of this embodiment, a knife arrangement 15 or the like is provided for the purpose of forming said flap parts as the fixture is rotated. A sleeve 17 carrying knife assembly 15 is arranged to move axially on the axle or shaft 14 and is held substantially against rotation on the shaft 14 by means of a key and key-way arrangement 16, said knife assembly being intended too move into the cutting slots 9' and cut the requisite slits 3'' in the sheet.

Figure 7:
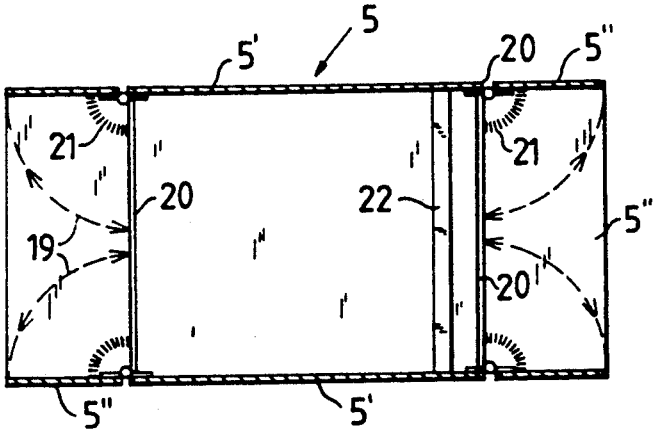
FIG. 7 is a schematic, central longitudinal sectional view of an embodiment of an inventive fixture provided with collapsible support parts.

FIG. 7 illustrates a still further embodiment of the inventive fixture in which the support parts 5'' can be folded or collapsed to and extended from an end-wall position, as indicated by the arrows 19. In this case, when the arrangement includes four support parts 5'' at respective ends of the fixture, the support parts are preferably capable of being collapsed and extended in pairs. Embodiments are conceivable in which only two mutually opposing support parts 5'' are provided at each end of the fixture. In this case, cutting slits are formed by omitting two side parts, cutting of the sheet being effected along the longitudinal edges of said support parts. In the case of embodiments which include foldable support parts, no strips 10 are required for producing folding lines, since folding of the flap parts 3 of a sheet blank can be effected along the wall edge 20 of the central fixture part.

The supports parts 5'' are preferably capable of being fixed in their respective end-wall positions, with the aid of suitable latching devices, and optionally of being returned from the end-wall position under the action of spring forces 21, as illustrated in FIG. 7.

The manner in which the inventive apparatus works, and also the working steps of the inventive method, will be understood in all essentials from the aforegoing. Thus, one edge part of a sheet for a sheet blank, which sheet may consist of a piece of a used, larger carton or box, is appropriately attached to the fixture and the sheet rotated so as to wrap around the fixture. Protruding parts of the sheet are cut away and flap parts are formed by means of substantially longitudinally extending cuts to make a sheet blank. A sheet blank mounted on the fixture is shown in broken lines in FIG. 2.

In the case of the embodiment illustrated in FIG. 7 if desired, a carton or box 1 can be produced on the same folding fixture. In this case, cuts are made along the lines 3'' FIG. 1 to provide flap parts 3, whereafter the flap parts at one end of the fixture, and also the end-wall parts, are folded to an end-wall position in order to close one end of the carton or box, whereafter said parts are secured permanently with the aid of adhesive tape or the like. The flap parts at the other end are folded in a corresponding manner, although closure of the box or carton is not made permanent and the flap parts, and suitably also the support parts, can be re-extended to an open position, whereafter the fixture, possibly with the aid of an internal handle 22, is lifted from the carton or box thus constructed.

It will be understood from the aforegoing that the method and apparatus according to the invention provide a solution to the aforesaid problem of producing cartons, boxes and the like in a rational manner at low cost.

Although the invention has been described with reference to illustrative embodiments thereof, it will be understood that other embodiments and minor modifications to those embodiments shown are conceivable, without departing from the concept of the invention.

For instance, cartons in which the tubular carton part 2 comprises a desired number of side parts 4, for instance three such parts, can be produced, by appropriate configuration of the cross-sectional outer profile of the central part of the fixture.

Furthermore, it is conceivable to provide flap parts 3 solely at one end of the carton part 2. It is also conceivable to provide flap parts solely on certain ones of the side parts 4.

Those cuts 3'' by means of which the flap parts are formed can, of course, be produced in a manner different to that described. For instance, the cuts can be made manually with the aid of a knife, such as the knife 18 shown in FIG. 1.

The invention shall not therefore be considered as limited to the aforedescribed and illustrated embodiments, since modifications can be made within the scope of the following claims.

I claim:

1. A method for manufacturing a sheet blank, adapted to be folded to a carton, from a sheet of carton material, said carton comprising a substantially tubular carton part which, in cross-section, has at least three sides and which is constructed from a sheet blank with a continuous row of sequential adjacent carton portions which will form side parts of the carton, which sheet blank further includes flap parts located at least at one of the two ends of the tubular carton part at least at some of the side parts, the flap parts being adapted to close the tubular carton part, said method comprising making a sheet blank (1') of requisite configuration with the aid of a fixture (5) having a longitudinal extended shape, which corresponds to the longitudinal extended shape of the desired tubular carton part (2), and a cross-sectional outer profile which corresponds to the cross-sectional outer profile of the desired tubular carton part (2); by the steps of obtaining and mounting a sheet of carton material, of requisite size sufficient to make at least a sheet blank, on the fixture (5); the step of locating an edge part (8) of said sheet of carton material contiguous with a longitudinally extending corner part (9) of the fixture, said corner part (9) forming a demarcation line between two mutually adjacent side parts (4); the step of folding and wrapping the sheet of carton material around the fixture to form said desired tubular carton part and the contiguous flap parts (3), which form a continuation of said tubular carton part; and the steps of slitting and removing excessive parts of the sheet of carton material, while wrapped on the fixture, as necessary to make the final shaped sheet blank, while using the fixture as a template.

2. A method according to claim 1, wherein said fixture has a locking slot, the step of locating, including the specific step of inserting, said edge part (8) into the locking slot (7) in the fixture whereby the sheet of material is retained by said locking slot while folding and wrapping the sheet of carton material around said fixture, to form a securing flap (8') by means of which the tubular carton part can be held together.

3. A method according to claim 1, wherein the flap parts (3) are formed by the step of making cuts extending substanially in the longitudinal direction of the fixture, and wherein the cuts are made with the aid of cutting slots (3') in the fixture which extend substantially in said longitudinal direction and which enable the fixture to be used as a template.

4. A method according to claim 1, including the step of forming folding lines (11) in the junctions between the tubular carton part (2) of the sheet and the flap parts (3) of the sheet with the aid of strips (10) mounted externally on the fixture and extending substantially transversely to said longitudinal direction.

5. A method according to claim 1, including the step of rotating the fixture about a longitudinal axis, wherein the sheet is wrapped around the fixture.

6. A method according to claim 1, including the step of making substantially longitudinal cuts (3'), in the sheet of carton material, to form said flap parts (3) with the aid of mechanically driven knife means (15).

7. A method according to claim 1, wherein the flap parts (3) arew folded to an end-wall position, which corresponds to a position in which the tubular carton part is closed, along the end-wall edges (20) of the tubular carton part, and in that all support parts forming templates in the formation of said flap parts are folded to an end-wall position.

8. A method according to claim 1, comprising the specific steps of producing a sheet blank (1') for the production of a substantially parallelepipedic carton (1) with the aid of the fixture (5), wherein that part (5') of said fixture which is intended to form the substantially tubular carton part (2) has a substantially rectangular cross-sectional shape.

9. Apparatus for manufacturing sheet blanks, said blanks being adapted to be folded to the shape of a carton from a sheet of carton material at least as large as the desired sheet blank, the carton which will be made from such a blank having a substantially tubular carton part which, in cross-section, has at least three sides and is constructed from a blank having a continuous row of sequentially disposed carton portions which form carton side parts, the blank further including flap parts at least one of the two ends of said resultant tubular carton part at least some of the carton side parts, said flap parts being adapted to close the resulting tubular carton part, said apparatus comprising: a fixture (5) which has a longitudinal extended shape that corresponds to the longitudinal extended shape of the tubular carton part (2), of the desired carton, and a cross-sectional outer profile shape which corresponds substantially to the cross-sectional outer profile shape of the tubular carton part (2) of the desired carton; said fixture including attachment devices (6) for receiving an edge part (8) of a sheet of carton material, said attachment devices perferably being located adjacent a longitudinally extending corner part (9) of the fixture, said corner part forming a demarcation between two mutually adjacent side parts (4) of the extended shape of said fixture, wherein the sheet of carton material is intended to be folded and wrapped around the fixture to form said tubular carton part (2) and flap parts (3) as a continuation of said carton part, and wherein the fixture is also configured to form a template, when it is found necessary, to provide a guide to aid in removal of excess parts of the sheet of carton material mounted and wrapped on the fixture.

10. Apparatus according to claim 9, wherein said fixture includes a sheet-retaining slot (7) which extends longitudinally along a corner part (9) of said fixture and in which said edge part (8) of a sheet of carton material is intended to be inserted so as to retain said edge part while folding and wrapping the sheet of carton material around said extended shape of said fixture, and thereby forming a securing flap (8') on the resultant sheet blank by means of which the resultant tubular carton part (2) can be held together.

11. Apparatus according to claim 10, wherein the slot (7) in said fixture has a predetermined depth to which said edge part (8) of the sheet material can be inserted, the depth of the slot (7) determining the length of the securing flap (8') transversely to the longitudinal extent of the intended tubular carton and thereby in the circumferential direction of the intended tubular carton part.

12. Apparatus according to claim 9, wherein the fixture includes support parts (12) which project from the fixture longitudinal shape substantially in the longitudinal direction; and wherein said support parts (12) include cutting slits (3') which enable the fixture to be used as a template, when forming said flap parts (3), with the aid of cuts (3'') between the individual flap parts made substantially in the longitudinal direction of the fixture adjacent said cutting slits.

13. Apparatus according to claim 9, wherein means mount said support parts to the fixture and enable said support parts (5'') to be folded to an end-wall position of said fixture, whereby the flap parts (3) of a sheet blank with said support parts folded can be folded to an end-wall position along the wall edges (20) of the wrapped tubular carton part of a sheet blank so as to form folding creases at the flap parts along which the tubular carton part can be closed by folding the flap parts.

14. Apparatus according to claim 9, wherein the fixture includes externally mounted strip means (10) which extend substantially transversely to said longitudinal direction at the ends of the part (5') of the fixture which corresponds to the intended tubular carton part, said strip means (10) functioning to press folding line (11) depressions in the sheet of material at the junction between the tubular carton part and the flap parts.

15. Apparatus according to claim 9, wherein means are connected to said fixture for rotating said fixture about a longitudinal axle.

16. Apparatus according to claim 9, wherein a knife means assembly (15) is provided adjacent said fixture and is operative to make substantially elongated cuts, in a sheet blank on the fixture which forms flap parts on the sheet blank.

17. Apparatus according ro claim 9, wherein the part (5') of said fixture, by means of which the substantially tubular carton part is formed, has a substantially rectangular cross-sectional outer profile.

18. Apparatus according to claim 9, wherein said fixture includes a substantially tubular body having a central part (5') intended to form said tubular carton part of a carton, and two end parts (12), connected with said central part, intended to form flap parts on the tubular part of a carton sheet blank, said end parts provide requisite slits (3'), such as corner-part based slits enabling cutting guides for splitting between flap parts of a sheet blank for a carton.

19. Apparatus according to claim 18, wherein said tubular body includes two internal end-wall parts (13), and a said end-wall part is located at each of the junctions between said central part and respective said end parts.

* * * * *